US006430747B1

(12) United States Patent
Lee

(10) Patent No.: US 6,430,747 B1
(45) Date of Patent: Aug. 13, 2002

(54) AUXILIARY SHIRT CUFF

(76) Inventor: Daniel A. Lee, 156 Flamingo Way Apt 03, Tallahassee, FL (US) 32304

( * ) Notice: Subject to any disclaimer, the term of this patent is extended or adjusted under 35 U.S.C. 154(b) by 0 days.

(21) Appl. No.: 09/859,992

(22) Filed: May 18, 2001

(51) Int. Cl.[7] ..... A41D 27/16
(52) U.S. Cl. ..... 2/60; 2/59; 2/123; 2/124
(58) Field of Search ..... 2/59, 60, 46, 123, 2/124

(56) References Cited

U.S. PATENT DOCUMENTS 148,178 A * 3/1874 Chase ..... 2/124
1,097,024 A * 5/1914 Holverson ..... 2/123
1,239,944 A * 9/1917 Newman ..... 2/123
1,391,205 A * 9/1921 Newman ..... 2/123
1,484,187 A * 2/1924 O'Neill et al. ..... 2/123
1,546,588 A * 7/1925 Kugore ..... 2/123
2,209,376 A * 7/1940 Augustin ..... 2/123
D193,760 S * 10/1962 Sanders ..... 2/124
3,137,861 A * 6/1964 Sanders ..... 2/123
3,594,819 A * 7/1971 Mullins ..... 2/170
5,070,544 A * 12/1991 Aliberti et al. ..... 2/170

* cited by examiner

*Primary Examiner*—Gloria M. Hale
(74) *Attorney, Agent, or Firm*—John Wiley Horton

(57) ABSTRACT

An auxiliary shirt cuff which can be applied to virtually any type of shirt. It does not require any modification to the shirt. When applied, the cuff gives the appearance of a high-quality french cuff shirt. It can be applied to a shirt already having a french cuff, or to one having a conventional button cuff. Different fabrics and colors can be employed to make the cuff, thereby creating a pleasing and fashionable contrast with the fabric and color of the shirt to which the cuff is applied.

4 Claims, 8 Drawing Sheets

AUXILIARY SHIRT CUFF

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of clothing. More specifically, the invention comprises a removable shirt cuff which can be applied to shirts having french cuffs or the more common button cuffs.

2. Description of the Related Art.

Removable shirt cuffs were once more common than they are today. Back when the typical consumer could only afford a new shirt every year or so, it was practical to provide for replaceable cuffs so that a worn out cuff would not require the replacement of the entire shirt. U.S. Pat. No. 1,314,325 to Heeren (1919) discloses one such device. The shirt is modified with a special attaching flap. A series of stud buttons arrayed around the shirt sleeve's perimeter engaged a corresponding series of button holes in the cuff. The special attaching flap serves to conceal these studs, thereby giving the visual impression of a conventional cuff. The Heeren cuff can only be used with a specially-modified shirt. It cannot be used with a shirt already having a conventional cuff.

A different approach is taken in U.S. Pat. No. 1,319,851 to Daily (1919). Like the Heeren device, the Daily cuff uses a special flap attached to the shirt sleeve—though the flap is smaller. This flap slips through an elongated slot in the cuff, folding back on a securing button.

U.S. Pat. No. 1,326,514 to Ladd (1917) uses two large buttons on the shirt sleeve, and a series of smaller fasteners arrayed around the shirt sleeve's perimeter. It results in an unconventional appearance—at least by modern standards—since it leaves a portion of the shirt sleeve material protruding beyond the bottom of the cuff (see FIG. 1).

A detachable cuff also having an unusual appearance is disclosed in U.S. Pat. No. 1,349,987 to Strumph (1,349, 987). This device uses an extra internal fold in the shirt sleeve to form a clevis joint. The edge of the detachable cuff which faces the sleeve then becomes the tang in the formation of a tang and clevis joint. A set of additional fasteners are disposed around the rear of the cuff to secure its perimeter to the shirt sleeve.

Another tang and clevis joint is employed in U.S. Pat. No. 1,413,897 to Calco (1922). In this variation, the clevis is formed in the rear edge of the cuff by making a second flap. The tang is actually the forward edge of the shirt sleeve. Three buttons or studs, arranged around the perimeter of the sleeve, are then employed to secure the cuff to the sleeve. A similar approach is taken in U.S. Pat. No. 1,645,833 to Torme (1924)—although without the use of the tang and clevis.

All these prior are devices result in a cuff being detachable from the shirt. However, they have inherent limitations in that:

1. All employ modified shirt sleeves, meaning that the cuff can only be used with a particularly suited shirt;
2. All employ at least three fastening points, making them cumbersome to apply;
3. None of the shirts disclosed may be used without the cuffs;
4. None of the cuffs can be applied to a shirt already having a cuff; and
5. Some of the cuffs give an unconventional appearance.

BRIEF SUMMARY OF THE INVENTION

The present invention is a removable auxiliary cuff which can be applied to virtually any type of shirt. It does not require any modification to the shirt. When in place, the cuff gives the appearance of a high-quality french cuff shirt. It can be applied to a shirt already having a french cuff or to one having a conventional button cuff. Different fabrics and colors can be employed to make the cuff, thereby creating a pleasing and fashionable contrast with the fabric and color of the shirt to which the cuff is applied.

REFERENCE NUMERALS IN THE DRAWINGS

| | | | |
|---|---|---|---|
| 10 | auxiliary shirt cuff | 12 | main body |
| 14 | cuff link flap | 16 | stiffener |
| 18 | cuff link hole | 20 | first fold |
| 22 | clevis flap | 24 | bevel |
| 26 | bevel flap | 28 | clevis gap |
| 30 | french cuff shirt | 32 | french cuff |
| 34 | leading edge | 36 | button cuff shirt |
| 38 | button cuff | 40 | button |
| 42 | button hole | 44 | cuff link |
| 46 | upper cuff region | 48 | descending cuff tab |
| 50 | descending tab | 52 | upper region |
| 54 | second fold | | |

DETAILED DESCRIPTION OF THE INVENTION

Figure 1:
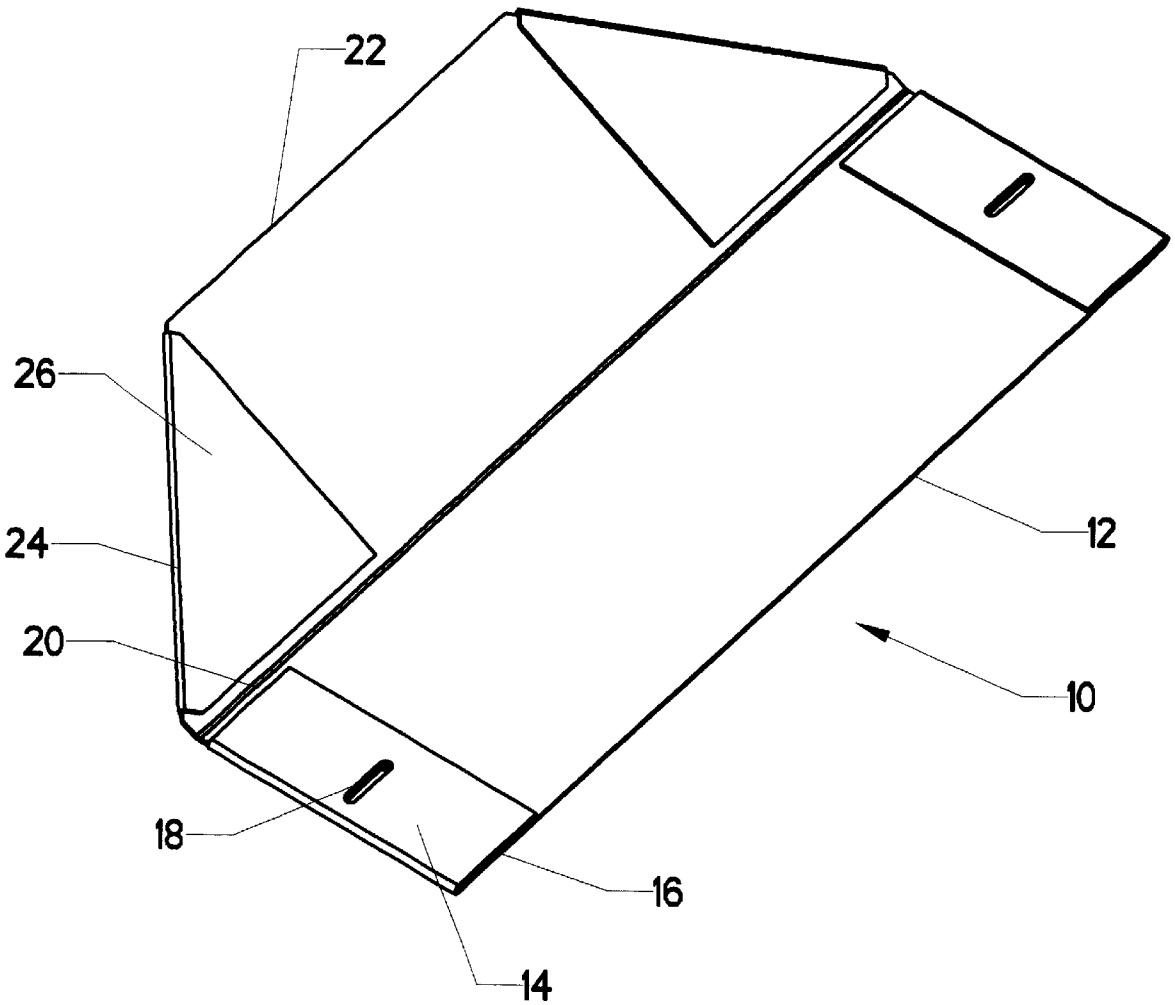
FIG. 1 is an isometric view, showing the proposed invention.

FIG. 1 shows the present invention as it is being formed. Auxiliary shirt cuff 10 has main body 12, which is a rectangular piece of flat fabric. Clevis flap 22 is joined to main body 12 along first fold 20. Those skilled in the art will appreciate that main body 12 and clevis flap 22 are easily made from one piece of fabric.

Clevis flap 22 is typically formed in the shape of a trapezoid. The two non-parallel sides have bevels 24, so that the angle formed between first fold 20 and the two bevels 24 is approximately 45 degrees. Bevels 24 may optionally also feature bevel flaps 26, which are folded flat clevis flap 22. Bevel flaps 26 provide extra rigidity to bevels 24. They are advantageous for certain thinner fabrics, but are often not needed.

The two short sides of main body 12 are formed into cuff link flaps 14. These features provide reinforcement around cufflink holes 18. It is also possible to insert stiffeners 16 into cuff link flaps 14. These stiffeners—which are typically made of thin plastic—help keep the outer edges of cuff link flaps 14 rigid, which can give the folded cuff a neater appearance. Those skilled in the art will realize that cufflink flaps 14 and bevel flaps 26 can be easily sewn in place.

Figure 2:
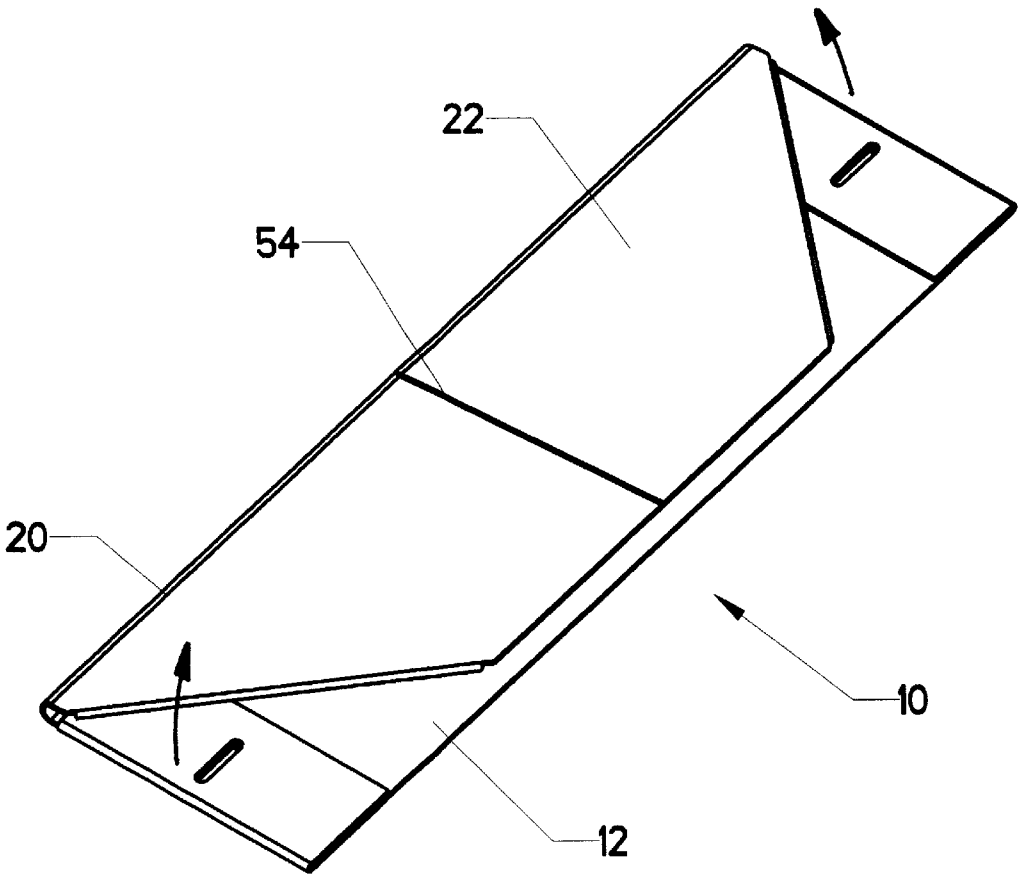
FIG. 2 is an isometric view, showing the invention in a folded state.

FIG. 2 shows auxiliary shirt cuff 10 with clevis flap 22 having been folded back against main body 12. As all the components are made of thin and flexible fabric, it is common for auxiliary shirt cuff 10 to lay flat as shown. In this state, numerous versions of the invention can be stacked flat in a clothes drawer.

When the user desires to affix auxiliary shirt cuff 10 to a shirt, he or she folds auxiliary shirt cuff 10 as shown by the two arrows, with the fold generally being centered on second fold 54.

Figure 3:
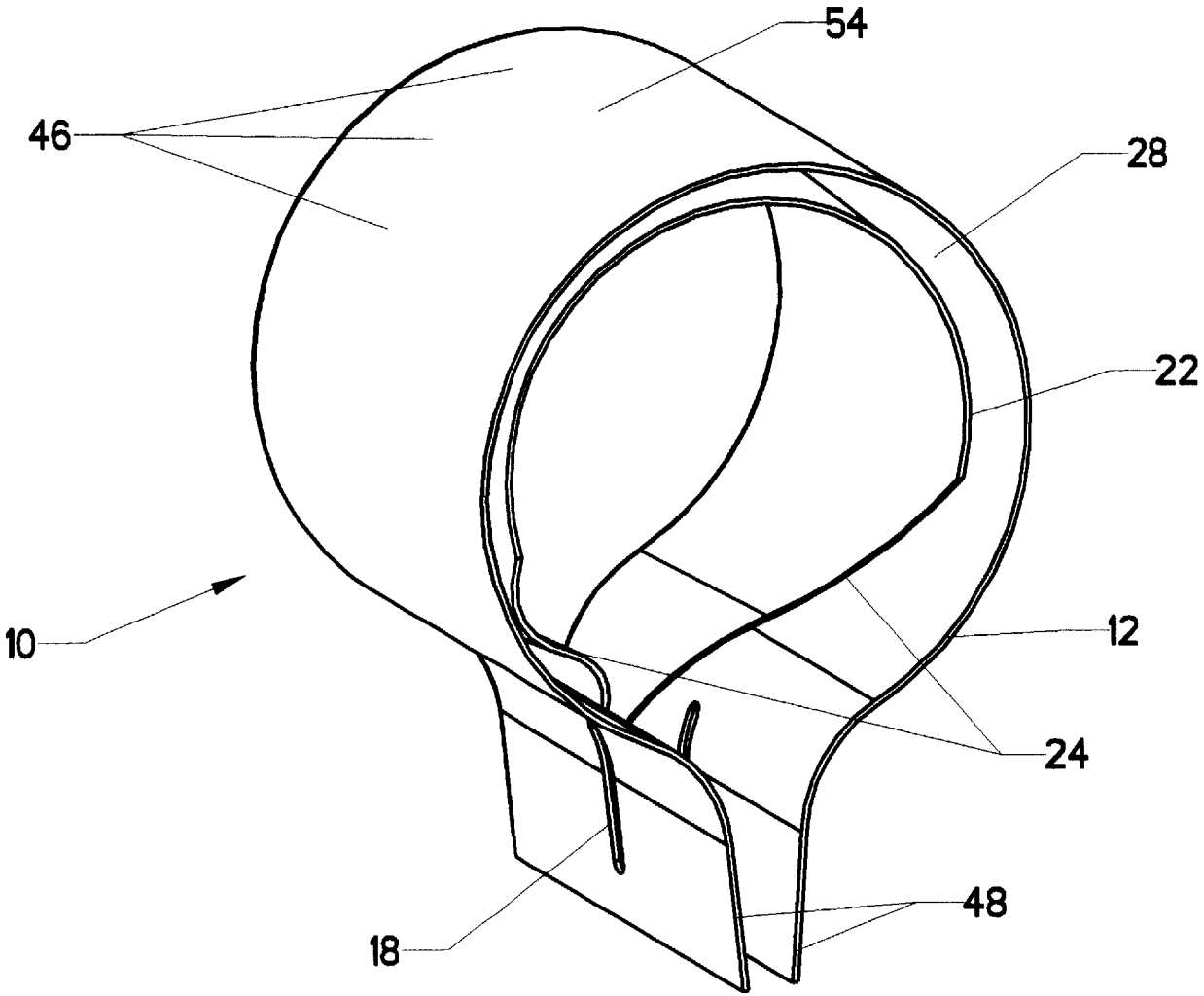
FIG. 3 is an isometric view, showing the invention just prior to application to a shirt sleeve.

FIG. 3 shows auxiliary shirt cuff 10 after the completion of second fold 54. The reader will observe that second fold 54 is not sharp. Instead, second fold 54 creates upper cuff region 46, having a generally arcuate shape, and two descending tabs 48. Clevis flap 22 is also formed into a generally arcuate shape, with the distance between clevis flap 22 and main body 12 forming clevis gap 28. Clevis gap 28, of course, also has an arcuate shape.

The reader will observe that bevels 24 are seen in the non-parallel sides of clevis flap 22 (the version illustrated in FIG. 3 does not have bevel flaps 26 attached to bevels 24). Bevels 24 carry out an important function. Once the invention is formed into approximately the state shown in FIG. 3, the user must push auxiliary shirt cuff 10 onto a conventional shirt cuff by pushing the leading edge of the shirt cuff into clevis gap 28. Frictional forces will obviously exist between the shirt cuff and the fabric of auxiliary shirt cuff 10. Main body 12 will slide outside the perimeter of the conventional shirt cuff. Clevis flap 22 will slide inside the perimeter of the conventional shirt cuff. The use of bevels 24 means that only a percentage of the entire perimeter of clevis flap 22 need be initially introduced against the inner surface of the conventional shirt cuff. As auxiliary shirt cuff 10 is worked further and further onto the conventional shirt cuff, a greater and greater surface area of clevis flap 22 makes contact. This gradual introduction of surface contact aids in the installation of the device. While the device could function without bevels 24, it would be significantly more difficult to install. Accordingly, the version having bevels 24 is the preferred embodiment.

Figure 4:
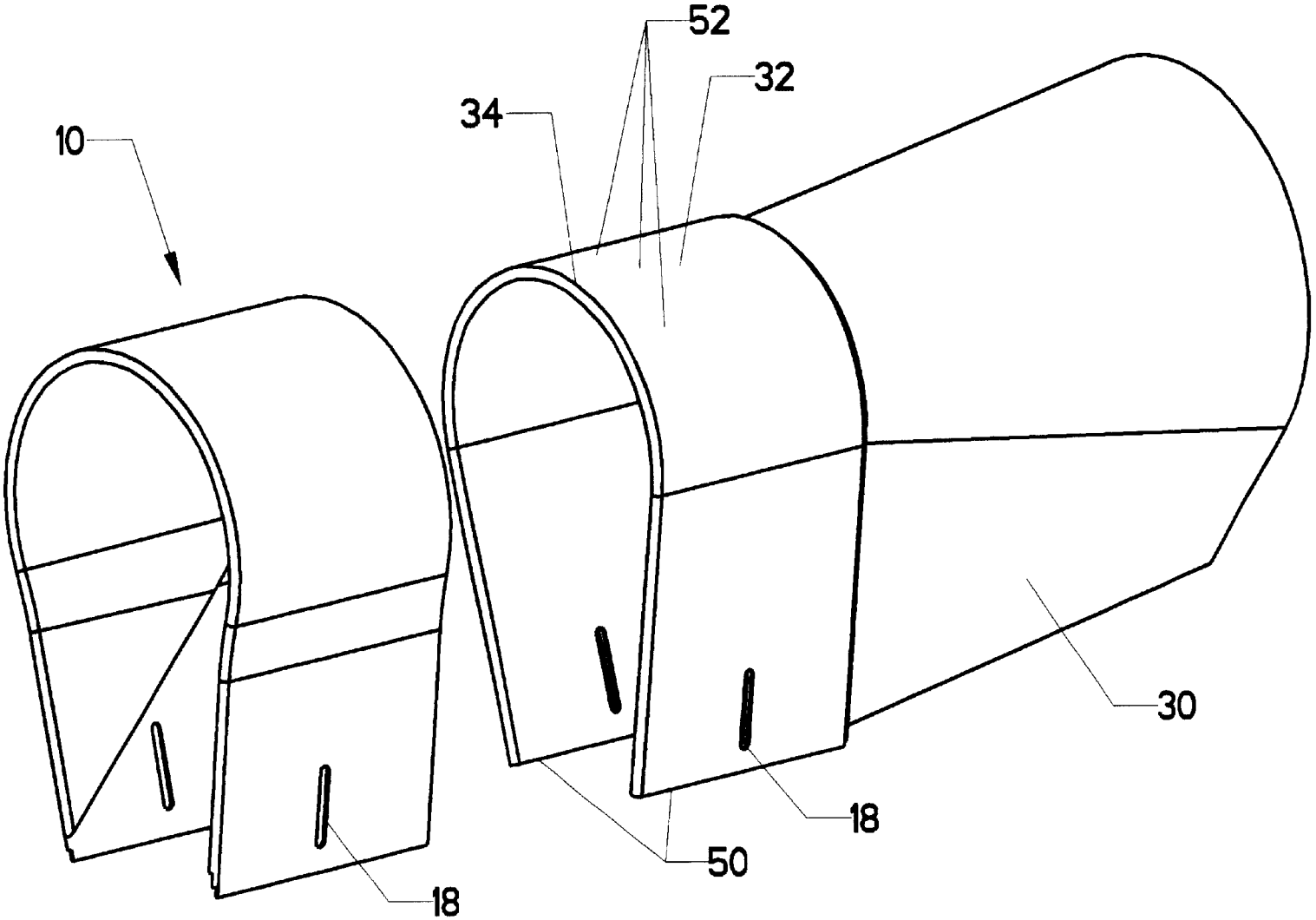
FIG. 4 is an isometric view, showing the application of the invention to a french cuff shirt.

FIG. 4 shows the installation of auxiliary shirt cuff 10 on french cuff shirt 30. The reader will observe that french cuff shirt 30 has french cuff 32, which comprises upper region 52, two descending tabs 50, and two cufflink holes 18. Leading edge 34 has a generally arcuate shape near its top, and two essentially linear regions descending down descending tabs 50. The user must install auxiliary shirt cuff 10 by aligning the two cufflink holes in auxiliary shirt cuff 10 with the two cufflink holes in french cuff 34.

Figure 4B:
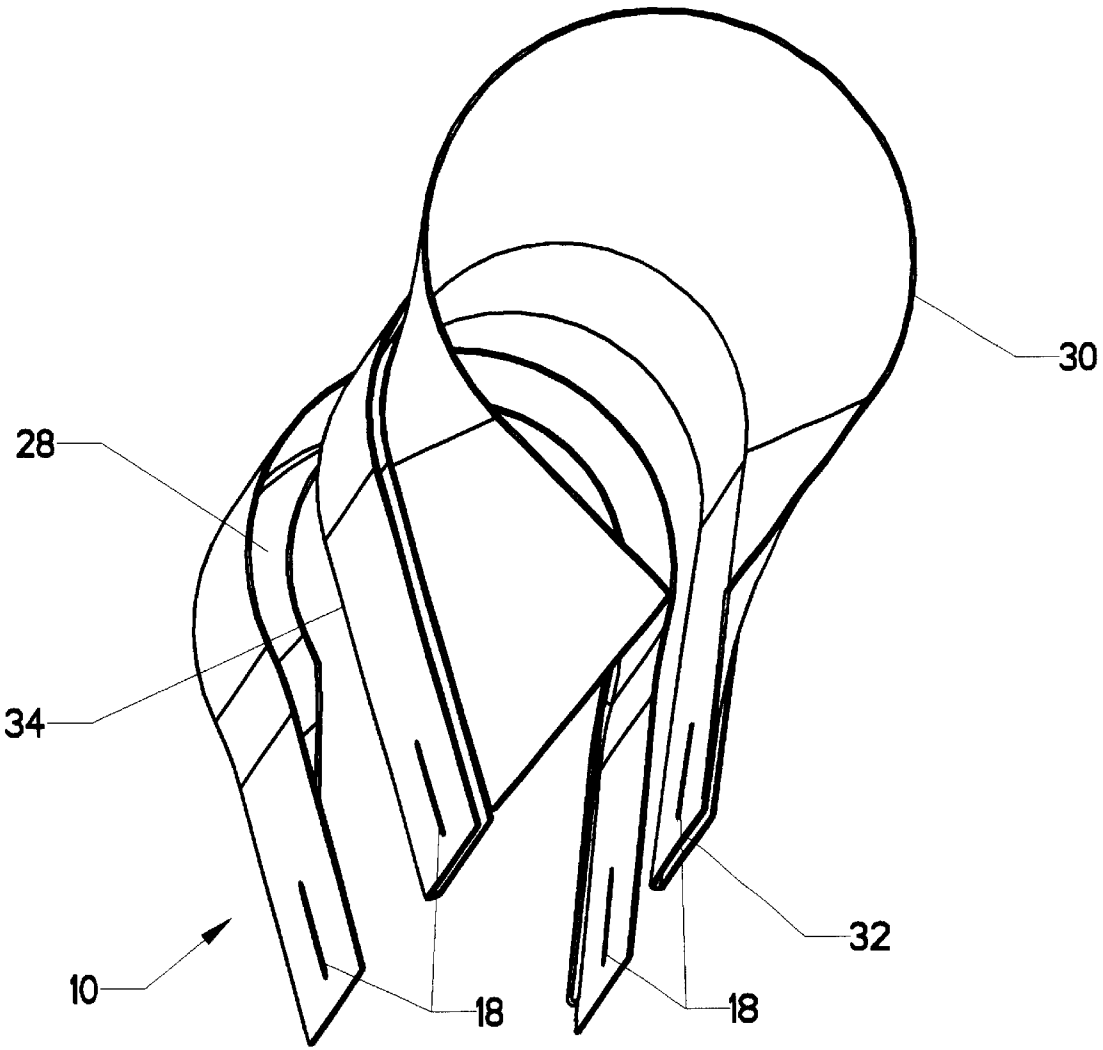
FIG. 4B is an isometric view, showing the application of the invention to a french cuff shirt from a different perspective.
Figure 6:
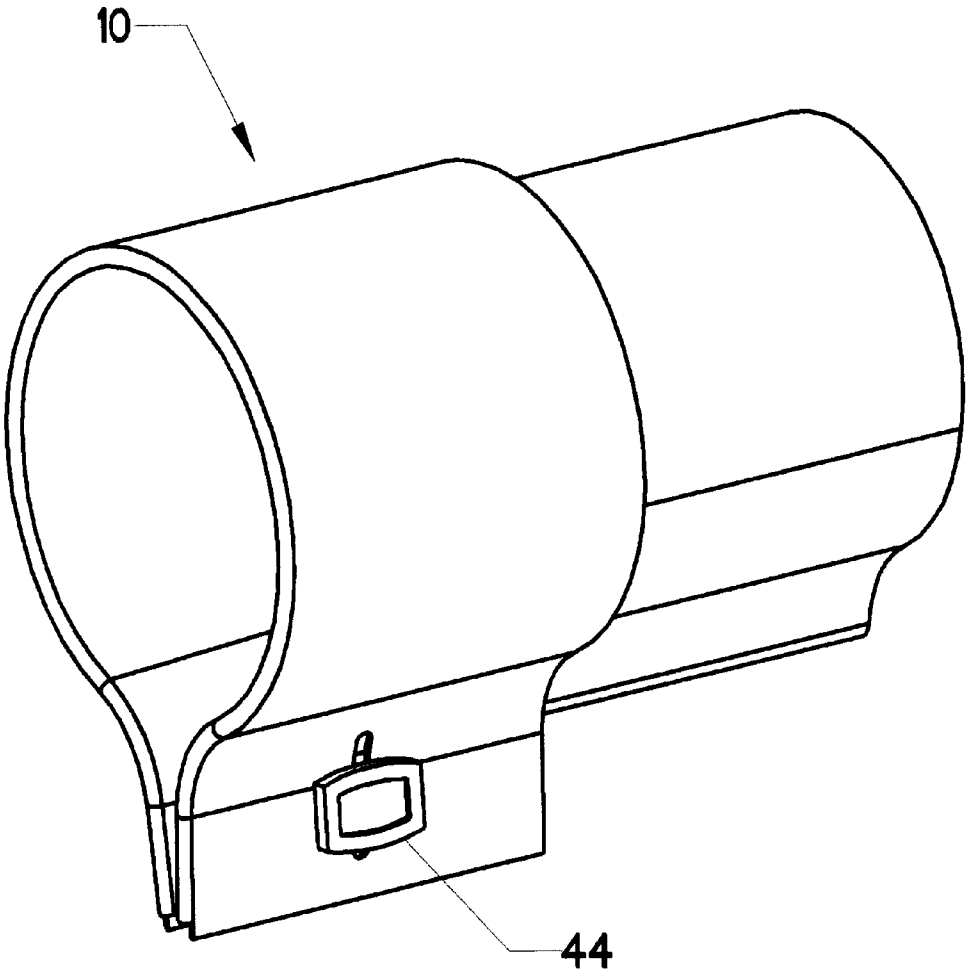
FIG. 6 is an isometric view, showing the invention as it appears when installed.

FIG. 4B shows the installation from another perspective. The reader will observe that as auxiliary shirt cuff 10 is pressed onto french cuff 32, leading edge 34 will slide into clevis gap 28. Once leading edge 34 is placed firmly within clevis gap 28, all four cuff link holes 18 are aligned and a cuff link is placed through the holes to lock the assembly in place. The completed assembly then takes on the appearance depicted in FIG. 6, with auxiliary shirt cuff 10 being held in place by cufflink 44. Once secured in place, an observer cannot discern the fact that auxiliary shirt cuff 10 is not an integral part of the shirt.

Figure 5:
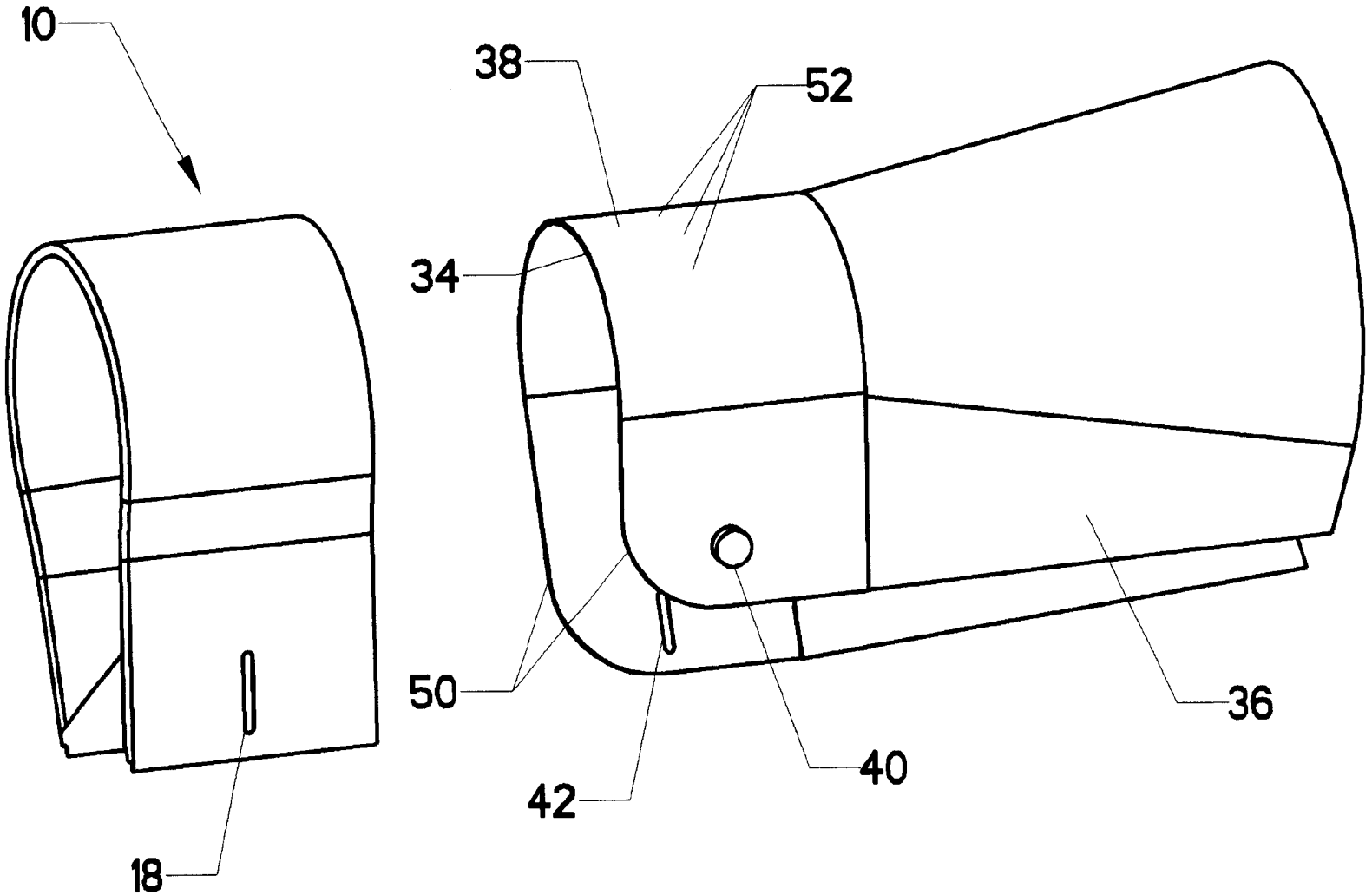
FIG. 5 is an isometric view, showing the application of the invention to a button cuff shirt.

FIG. 5 shows the installation of auxiliary shirt cuff 10 on button cuff shirt 36. Button cuff shirt 36 has button cuff 38, which comprises upper region 52, two descending tabs 50, button hole 42, and button 40. Leading edge 34 has a generally arcuate shape near its top, and two essentially linear regions descending down descending tabs 50. Prior to installation, it is important that the user pull the descending tab 50 having button hole 42 down below the descending tab 50 having button 40—as shown.

Figure 5B:
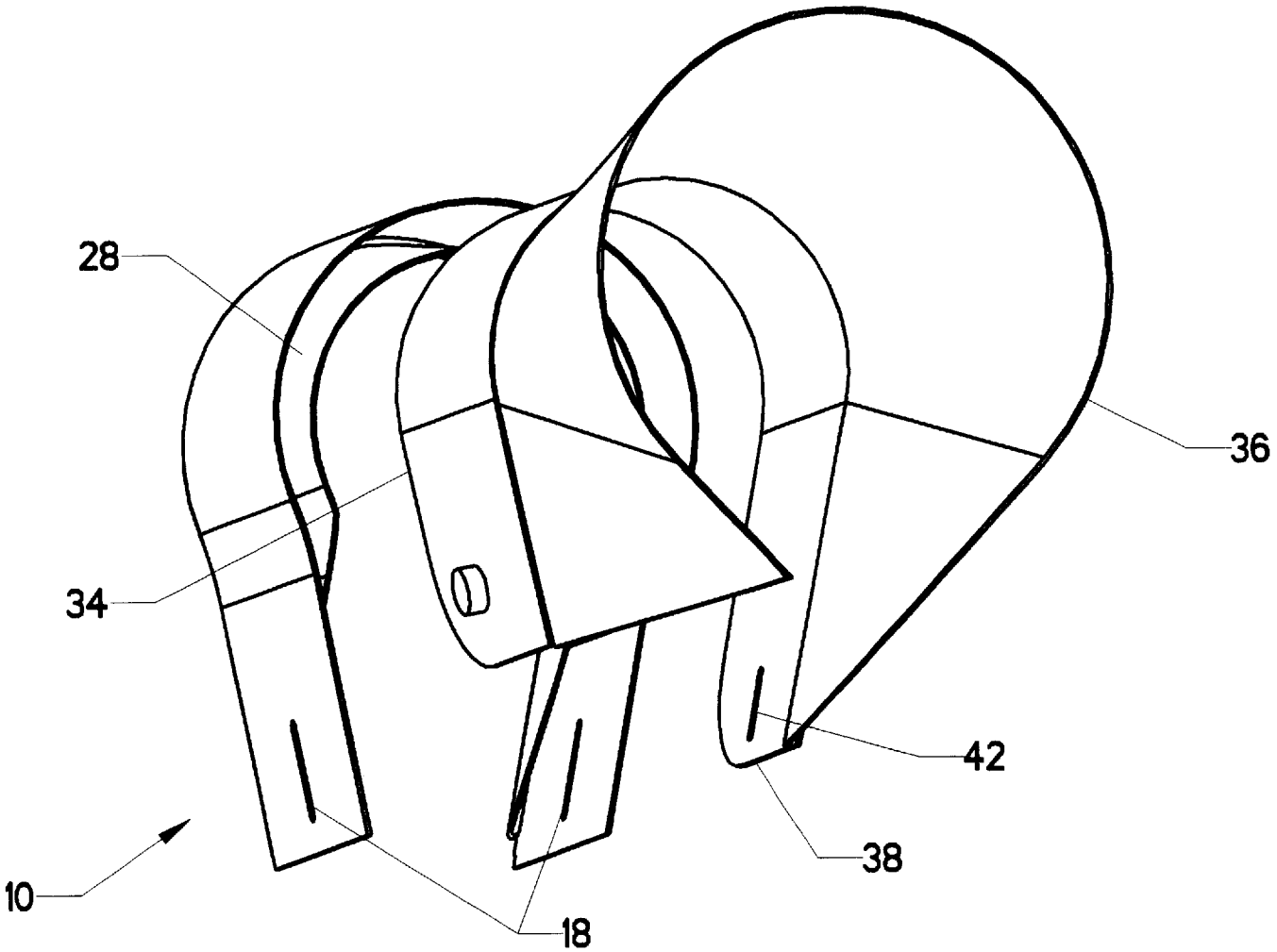
FIG. 5B is an isometric view, showing the application of the invention to a button cuff shirt from a different perspective.

FIG. 5B shows the installation from another perspective. The reader will observe that as auxiliary shirt cuff 10 is pressed onto button cuff 38, leading edge 34 will slide into clevis gap 28. Once leading edge 34 is placed firmly within clevis gap 28, the two cuff link holes 18 are aligned with button hole 42 and a cufflink is placed through the holes to lock the assembly in place. The completed assembly then takes on the appearance depicted in FIG. 6, with auxiliary shirt cuff 10 being held in place by cufflink 44. As with the previously described installation on a french cuff shirt, an observer cannot discern the fact that auxiliary shirt cuff 10 is not an integral part of the shirt.

The use of auxiliary shirt cuff 10 allows many practical and stylistic advantages. These include the following:

1. A worn out or stained cuff can be covered, thereby saving an otherwise ruined shirt;
2. Different colors and patterns can be used in manufacturing auxiliary shirt cuff 10, allowing a user to express his or her own personal style; and
3. A button cuff shirt can be temporarily converted into a french cuff shirt, without destroying its utility as a button cuff shirt.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described my invention, I claim:

1. An auxiliary shirt cuff designed to allow a user to attach said auxiliary shirt cuff to a french cuff on a shirt, wherein said french cuff includes an arcuate leading edge, an upper region, a first descending tab, a second descending tab, a first cuff link hole passing completely through said first descending tab, and a second cuff link hole passing completely through said second descending tab, wherein said auxiliary shirt cuff comprises:

a. a main body;

b. a clevis flap, attached to said main body by a first fold, wherein said clevis flap is folded back over said main body to form a clevis gap between said main body and said clevis flap, and wherein said clevis flap and said main body then undergo a second non-sharp fold to form an arcuate upper cuff region, a first descending cuff tab, and a second descending cuff tab;

c. wherein said main body, said clevis flap, and said clevis gap are all formed into an arc approximating the shape of said arcuate leading edge of said french cuff, wherein said clevis flap has a radius which is smaller than the radius of said arcuate leading edge of said french cuff and wherein said main body has a radius which is larger than the radius of said arcuate leading edge of said french cuff, so that when said user presses said removable auxiliary shirt cuff onto said french cuff said arcuate edge on said french cuff fits within said clevis gap;

d. wherein said first descending cuff tab opens into a first cuff link hole passing completely therethrough; and e. wherein said second descending cuff tab opens into a second cuff link hole passing completely therethrough, so that when said user pushes said arcuate leading edge on said french cuff within said clevis gap, said first cufflink hole in said first descending tab can be aligned with said first cuff link hole in said first descending cuff tab, and said second cuff link hole in said second descending tab can be aligned with said second cuff link hole in said second descending cuff tab.

2. A device as recited in claim 1, wherein:

a. said clevis flap is formed in the shape of a trapezoid, having a first side, a second side, a third side, and fourth side;

b. said first side lies on said first fold;

c. said third side is distal to said first fold and is parallel to said first side;

d. said second side has a first portion which is proximate said first fold and a second portion which is distal to said first fold, and wherein the angle formed between said first side and said second side is less than seventy-five degrees; and e. said fourth side has a first portion which is proximate said first fold and a second portion which is distal to said first fold, and wherein the angle formed between said first side and said fourth side is less than seventy-five degrees, so that the width of said clevis flap tapers significantly proceeding from said fold to said third side, so as to reduce initial frictional contact between said clevis flap and said french cuff during installation of said auxiliary shirt cuff.

3. An auxiliary shirt cuff designed to allow a user to attach said auxiliary shirt cuff to a button cuff on a shirt, wherein said button cuff includes an arcuate leading edge, an upper region, a first descending tab, a second descending tab, a button hole passing completely through said first descending tab, and a button mounted on said second descending tab, wherein said auxiliary shirt cuff comprises:

a. a main body;

b. a clevis flap, attached to said main body by a first fold, wherein said clevis flap is folded back over said main body to form a clevis gap between said main body and said clevis flap, and wherein said clevis flap and said main body then undergo a second non-sharp fold to form an arcuate upper cuff region, a first descending cuff tab, and a second descending cuff tab;

c. wherein said main body, said clevis flap, and said clevis gap are all formed into an arc approximating the shape of said arcuate leading edge of said button cuff, wherein said clevis flap has a radius which is smaller than the radius of said arcuate leading edge of said button cuff and wherein said main body has a radius which is larger than the radius of said arcuate leading edge of said button cuff, so that when said user presses said removable auxiliary shirt cuff onto said button cuff said arcuate edge of said button cuff fits within said clevis gap;

d. wherein said first descending cuff tab opens into a first cuff link hole passing completely therethrough; and e. wherein said second descending cuff tab opens into a second cuff link hole passing completely therethrough, so that when said user pushes said arcuate leading edge of said button cuff within said clevis gap, said button hole in said first descending tab can be aligned with said first cuff link hole in said first descending cuff tab and said second cuff link hole in said second descending cuff tab.

4. A device as recited in claim 3, wherein:

a. said clevis flap is formed in the shape of a trapezoid, having a first side, a second side, a third side, and fourth side;

b. said first side lies on said first fold;

c. said third side is distal to said first fold and is parallel to said first side;

d. said second side has a first portion which is proximate said first fold and a second portion which is distal to said first fold, and wherein the angle formed between said first side and said second side is less than seventy-five degrees; and e. said fourth side has a first portion which is proximate said first fold and a second portion which is distal to said first fold, and wherein the angle formed between said first side and said fourth side is less than seventy-five degrees, so that the width of said clevis flap tapers significantly proceeding from said fold to said third side, so as to reduce initial frictional contact between said clevis flap and said button cuff during installation of said auxiliary shirt cuff.

* * * * *